US007475651B1

(12) United States Patent
Dunn

(10) Patent No.: US 7,475,651 B1
(45) Date of Patent: Jan. 13, 2009

(54) STRUCTURAL SECTION

(75) Inventor: Paul M. Dunn, West Kingston, RI (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 11/831,304

(22) Filed: Jul. 31, 2007

(51) Int. Cl.
*B63G 8/00* (2006.01)

(52) U.S. Cl. ..... 114/341

(58) Field of Classification Search ..... 114/341
See application file for complete search history.

(56) References Cited

U.S. PATENT DOCUMENTS 4,453,363 A * 6/1984 Koller ..... 52/481.1
4,811,540 A * 3/1989 Kallies et al. ..... 52/630
5,012,622 A * 5/1991 Sato et al. ..... 52/721.4
5,727,496 A * 3/1998 Welch, Jr. ..... 114/312
5,746,411 A * 5/1998 Bruas et al. ..... 248/635
6,817,574 B2 * 11/2004 Solanille et al. ..... 244/117 R
7,178,304 B2 * 2/2007 Brady ..... 52/653.1
2007/0011970 A1 * 1/2007 Hethcock et al. ..... 52/481.1

* cited by examiner

*Primary Examiner*—Stephen Avila
(74) *Attorney, Agent, or Firm*—James M. Kasischke; Michael P. Stanley; Jean-Paul A. Nasser

(57) ABSTRACT

A structural element includes an internal rib and mounting structure having end ribs joined by rails to a plurality of intermediate ribs. A cylindrical skin positioned about the cylindrical rib and mounting structure allows the structure to slide in and out of the skin. A cylindrical male end joint can be a fastening to the end rib of the mounting structure to retain the structure within the skin. Likewise, a female end joint is secured on the other end rib of the structure to complete the structural element. The end joints are sealed against the skin to prevent leakage. The rails can be provided as rail sections joining adjacent ribs.

5 Claims, 3 Drawing Sheets

STRUCTURAL SECTION

STATEMENT OF GOVERNMENT INTEREST

The invention described herein may be manufactured and used by or for the Government of the United States of America for governmental purposes without the payment of any royalties thereon or therefore.

CROSS REFERENCE TO OTHER APPLICATIONS

None.

BACKGROUND OF THE INVENTION (1) Field of the Invention

The present invention relates to a structural section capable of withstanding high pressures and being relatively easy to manufacture.

(2) Description of the Prior Art

Underwater vehicles which operate at significant depth, such as torpedoes, targets and unmanned undersea vehicles employ a rib-stiffened, cylindrical structural element 10 as shown in FIG. 1. Structural element 10 has a clamped joint 12A and 12B at each end. These structural elements are one piece and are generally machined from a single aluminum forging (traditionally 6061-T6 or 7075-T6). Structural element 10 has a skin 14 with ribs 16 formed at intervals along the length of structural element 10. Female clamped joint 12A is shown in detail in FIG. 2A, and male clamped joint 12B is shown in FIG. 2B. When two structural elements 10 are joined together, inside shoulder 18 of joint 12B is positioned inside mating sleeve 20 of joint 12A. A joint band, not shown, is then positioned about the joint, extending into joint band grooves 22.

The ribs and joint design consume internal volume and reduce the clear bore through the hulls. In typical vehicles, a 21" outside diameter hull is reduced to 18.5" or less. Everything inside the structural element must pass through the narrowest diameter. This results in a 22% volume reduction. Unless an internal rail and carriage system is employed, maintenance access to components within the hull is limited to what can be reached via the ends. Significant disassembly is often required to repair a component centrally located within the hull.

SUMMARY OF THE INVENTION

One object of this invention is design of a structural element capable of withstanding pressures at operating depths.

Another object of this invention is providing a structural element having a greater useful volume.

Yet another object of this invention is providing a structural element that can be easily disassembled for maintenance of interior components.

Accordingly, an embodiment of the invention provides a structural element that includes an internal rib and mounting structure having cylindrical end ribs joined by rails to a plurality of cylindrical intermediate ribs. A cylindrical skin positioned about the rib and mounting structure allows the structure to slide in and out of the skin. A cylindrical male end joint can be a fastening to the end rib of the mounting structure to retain the structure within the skin. Likewise, a female end joint is secured on the other end rib of the structure to complete the structural element. The end joints are sealed against the skin to prevent leakage. The rails can be provided as rail sections joining adjacent ribs.

BRIEF DESCRIPTION OF THE DRAWINGS

These and other features and advantages of the present invention will be better understood in view of the following description of the invention taken together with the drawings wherein.

DETAILED DESCRIPTION OF THE INVENTION

Figure 1:
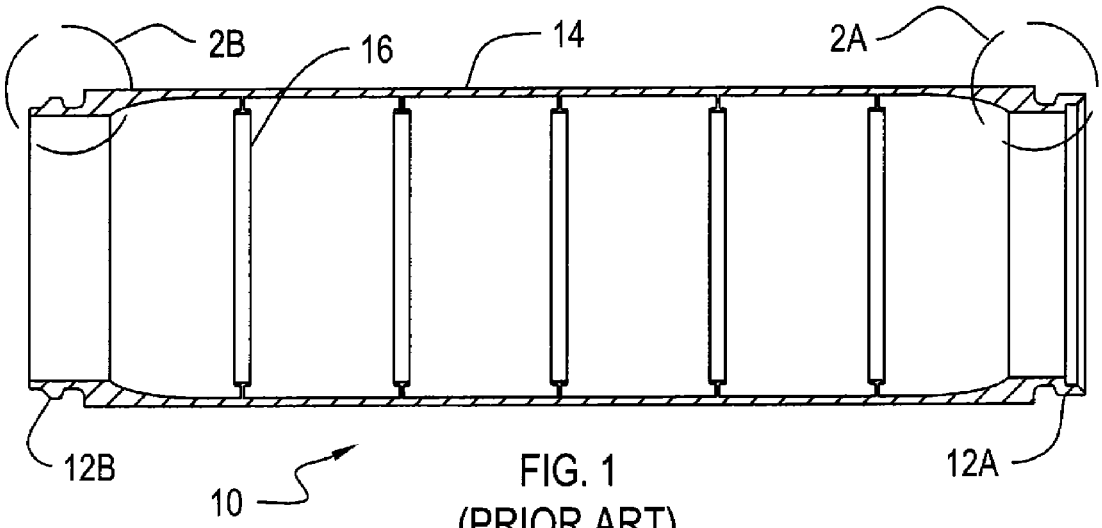
FIG. 1 (PRIOR ART)
FIG. 1 is a cross sectional view of a prior art hull segment.
Figure 2A:
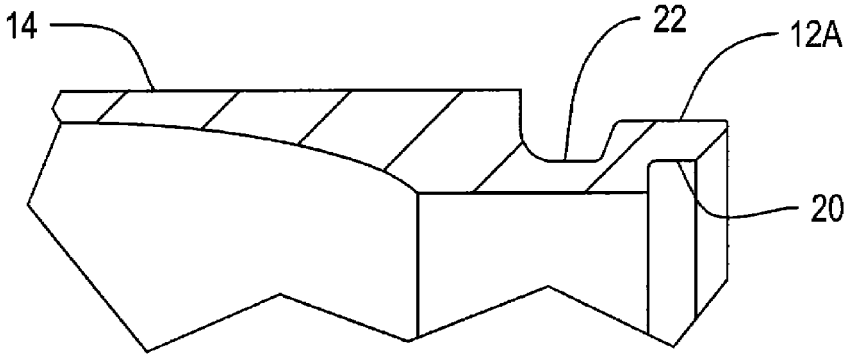
FIG. 2A (PRIOR ART)
FIG. 2A is a cross sectional view of a detail of FIG. 1 showing a female clamped join portion according to a prior art hull segment.
Figure 2B:
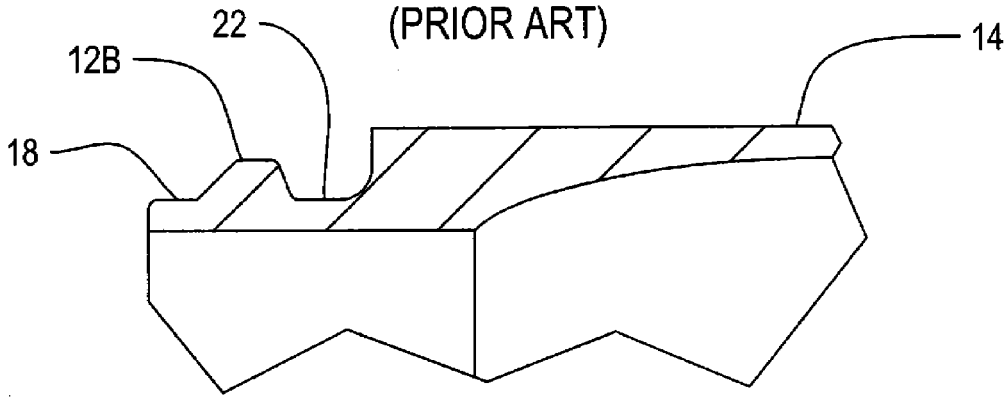
FIG. 2B (PRIOR ART)
FIG. 2B is a cross sectional view of a detail of FIG. 1 showing a male clamped join portion according to a prior art hull segment.
Figure 3:
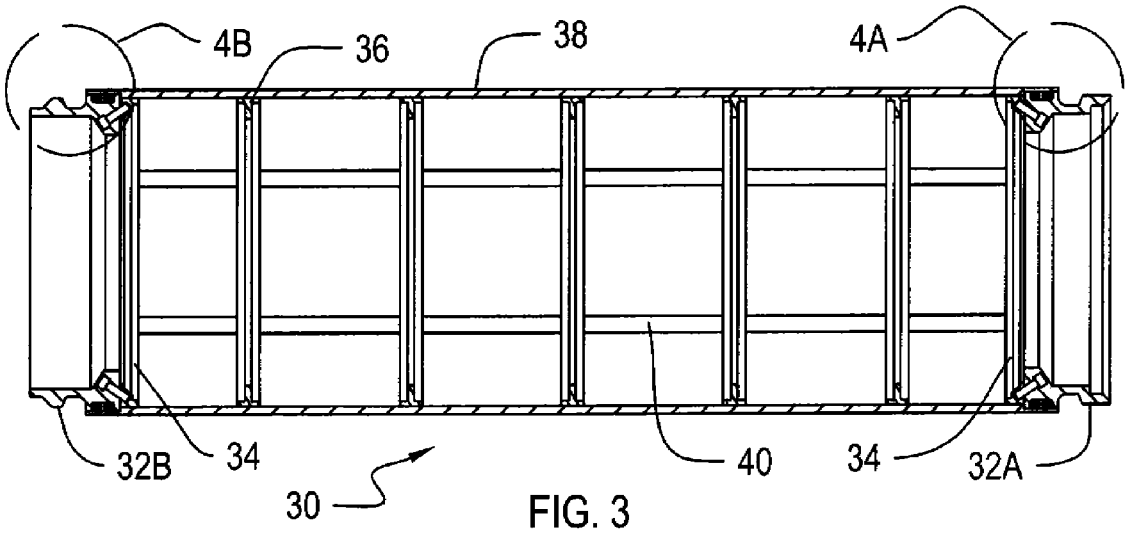
FIG. 3 is a cross sectional view of a hull segment according to the current invention.
Figure 4A:
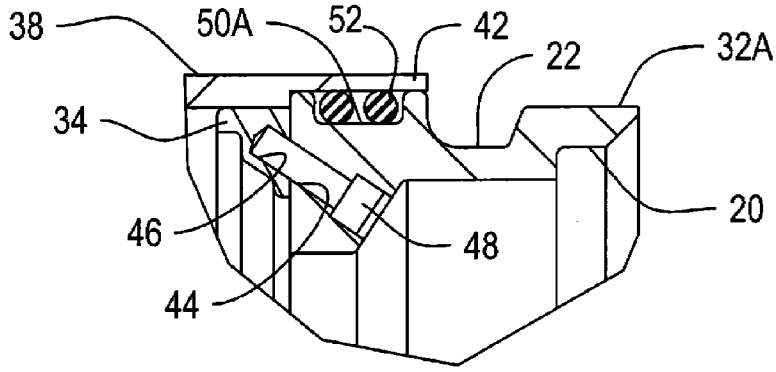
FIG. 4A is a cross sectional view of a detail of FIG. 3 showing a female clamped join portion according to an embodiment of the current invention.
Figure 4B:
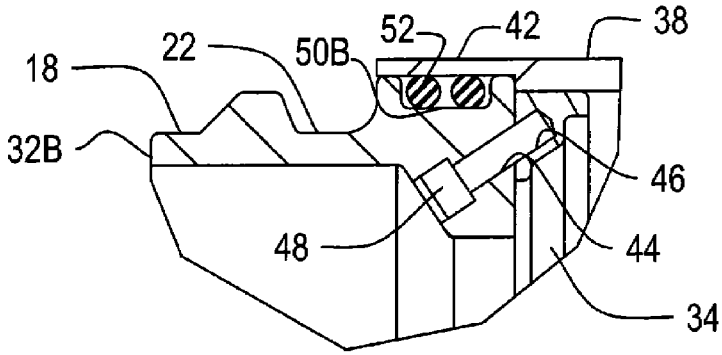
FIG. 4B is a cross sectional view of a detail of FIG. 3 showing a male clamped join portion according to an embodiment of the current invention.

FIG. 3 shows a structural element 30 according to an embodiment of the current invention. Structural element 30 includes a female end joint 32A, a male end joint 32B, end ribs 34, intermediate ribs 36, a skin 38, and support rails 40. The internal structure of structural element 30 includes intermediate ribs 36 joined coaxially by at least two support rails 40. An end rib 34 is positioned coaxially on each end of the internal structure. Intermediate ribs 36 are preferably circular with a "T" shaped cross section; however, other cross section shapes can be used. Support rails 40 are joined to ribs 34 and 36 by any means known in the art including welding and the use of fasteners.

Female end joint 32A and male end joint 32B have structures allowing compatibility with prior art joints 12A and 12B. These include an inside shoulder 18 formed on joint 32B that can be positioned inside a mating sleeve 20 of joint 32A. As before, after joints 32A and 32B are positioned together, a joint band is positioned about the combined joint, extending into joint band grooves 22.

Structural element 30 is assembled by sliding the internal structure into skin 38. Clearance between the inner diameter of skin 38 and the outer diameter of rib 36 is minimal to interference. Assembly of skin 38 about ribs 36 could utilize a temperature differential or a special fixture. Skin 38 has a thinned sleeve 42 formed at each end for receiving a joint 32A, 32B. Internal structure is retained within skin 38 by sliding female end joint 32A into thinned sleeve 42 and attaching joint 32A to one end rib 34. Male end joint 32B is slid within the other thinned sleeve 42 of skin and attached to the other end rib 34. Joints 32A and 32B can be joined to end ribs 34 by any means known in the art. In the preferred embodiment a plurality of apertures 44 are formed in joints 32A and 32B and corresponding apertures 46 are formed in end ribs 34. Fasteners such as bolts 48 secure joints 32A and 32B to end ribs 34. End rib apertures 46 can be formed with threading therein. External fasteners such as nuts can also be used. O-ring grooves 50A and 50B are formed about the exterior surface of joints 32A and 32B respectively for positioning an o-rings 52 about the joint 32A, 32B before it is slid into sleeve 42.

Figure 5:
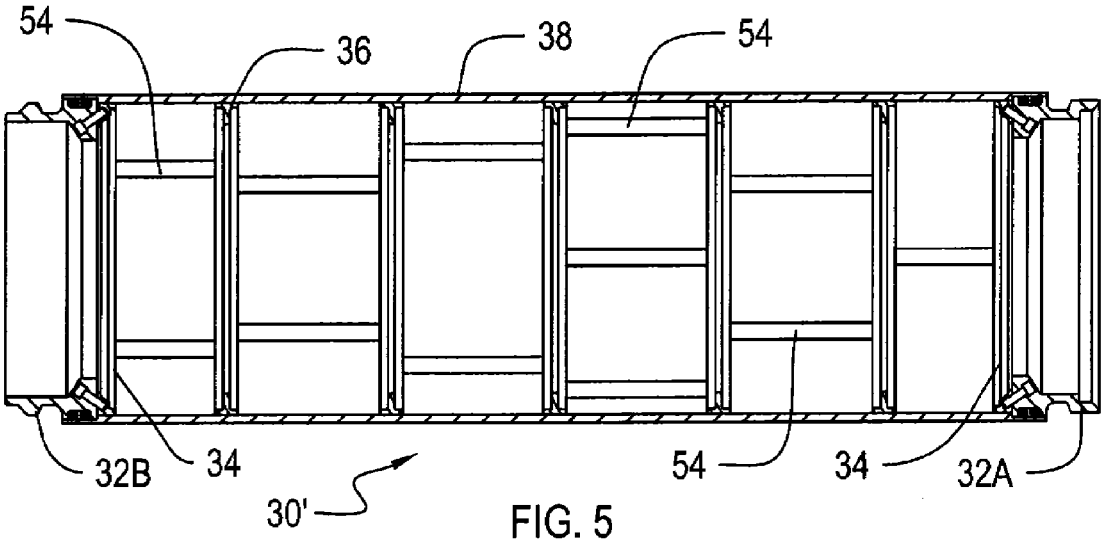
FIG. 5 is a cross sectional view of another embodiment of the current invention.

In another embodiment shown in FIG. 5, rails (shown as 40 in FIG. 3) can be multipart rails with each rail part 54 joining two adjacent ribs 34 and 36. Rails 40 provide stability and positioning to ribs 34 and 36 during assembly. Rail parts 54 can be configured to maintain internal structure rigidity while accommodating unusually shaped equipment within structural element 30'.

This embodiment features a cylindrical structural element having an internal structure that can be assembled and slid into an external skin. End joints are mounted to the internal structure to secure the structure within the skin. This allows mounting of internal vehicle equipment within the structure while the end joints and skin are removed for easy access to the equipment. The embodiment also allows greater utilization of the internal vehicle volume because there is less need to fit the equipment within the ribs of the vehicle. Material selection for the end joints, ribs and outer skin can be optimized for the specific strength and corrosion resistance required. The one piece construction of the prior art required one alloy that was not optimal in all locations. The current embodiment also reduces machining costs because parts are interchangeable, thickness is reduced, and rib construction is simplified.

In light of the above, it is therefore understood that within the scope of the appended claims, the invention may be practiced otherwise than as specifically described.

What is claimed is:

1. A structural element comprising:

an internal rib and mounting structure having two end ribs, a plurality of circular intermediate ribs, and a plurality of rail members joined between adjacent coaxial intermediate ribs, between an intermediate rib on a first end and an end rib, and between an intermediate rib on a second end of said structure and an end rib, said end ribs have a plurality of mounting apertures formed therein;

a cylindrical skin positioned about said internal rib and mounting structure;

a cylindrical male end joint positionable within said skin having a fastening means thereon capable of joining said male end joint to said end rib of said internal rib and mounting structure, said male end joint having a plurality of mounting apertures formed longitudinally therethrough;

a female end joint positionable within said skin having a fastening means thereon capable of joining said female end joint to said end rib of said internal rib and mounting structure, said female end joint having a plurality of mounting apertures formed longitudinally therethrough; and a plurality of fasteners for joining said male end joint to said end rib by extending through said male end joint mounting aperture into said end rib mounting aperture, and for joining said female end joint to said end rib by extending through said female end joint mounting aperture into said end rib mounting aperture.

2. The device of claim 1 wherein said plurality of rail members comprises at least two rail members extending from the first end of the internal rib and mounting structure to the second end of the internal rib and mounting structure, each rail member joining the end ribs and the intermediate ribs.

3. The device of claim 1 wherein:

said skin has thinned sleeves formed at the end portions thereof; and said male end joint and said female end joint are positionable within said thinned sleeves.

4. The device of claim 1 wherein:

said male end joint has an o-ring groove formed in an exterior surface thereof; and said female end joint has an o-ring groove formed in an exterior surface thereof.

5. The device of claim 4 further comprising at least two o-rings with one o-ring being positioned in said male end joint o-ring groove and with another o-ring being positioned in said female end joint o-ring groove.

* * * * *